United States Patent [19]

Bustos

[11] 4,099,625

[45] Jul. 11, 1978

[54] DISPLAY RACK

[75] Inventor: Rafael T. Bustos, Clarkston, Ga.

[73] Assignee: Leggett & Platt, Incorporated, Carthage, Mo.

[21] Appl. No.: 815,224

[22] Filed: Jul. 13, 1977

[51] Int. Cl.[2] ..... A47F 5/00

[52] U.S. Cl. ..... 211/49 R; 211/150; 220/21

[58] Field of Search ..... 211/49 R, 49 S, 153, 211/150; 220/21; 312/128, 42, 72; 217/19

[56] References Cited

U.S. PATENT DOCUMENTS

| | | | |
|---|---|---|---|
| 2,572,090 | 10/1951 | Allen | 211/49 R |
| 2,982,419 | 5/1961 | Shields | 211/49 R |
| 3,045,831 | 7/1962 | Pendergrast et al. | 211/49 R |
| 3,137,251 | 6/1964 | Pendergrast et al. | 108/110 |
| 3,151,744 | 10/1964 | Patterson | 211/49 |

FOREIGN PATENT DOCUMENTS

| | | | |
|---|---|---|---|
| 1,212,865 | 3/1966 | Fed. Rep. of Germany | 217/19 |

*Primary Examiner*—Roy D. Frazier
*Assistant Examiner*—Robert W. Gibson, Jr.
*Attorney, Agent, or Firm*—Wood, Herron & Evans

[57] ABSTRACT

A display rack in which articles are disposed in rows parallel one to the other, each row on an upper shelf being disposed in the same vertical longitudinal plane as an underneath row on a lower shelf. In preferred form, the display rack's upper shelf is comprised of a plurality of separably operable floor frames, each floor frame being structured to serve only one row of articles. The floor frame for each of the upper shelf's rows is comprised of a right hand support section and a left hand support section, each support section being separably pivotable on a pivot axis disposed parallel to the row's vertical longitudinal plane, and the pivot axes being disposed on opposite sides of that longitudinal plane. Each row floor frame is movable between a use position in which the support sections thereof are oriented to support one or more articles in that upper row, thereby preventing the articles in the underneath row from being removed vertically out of the display rack, and a storage position in which the support sections are removed when no article is in the upper row, thereby allowing the articles in the underneath row to be lifted vertically out of the display rack. The right and left hand support sections of each row floor frame are spring loaded, the weight of at least one article on both frame sections maintaining the frame in the use attitude, and the removal of all articles from the row floor frame permitting those sections to pivot into the storage attitude.

18 Claims, 3 Drawing Figures

DISPLAY RACK

This invention relates to display racks. More particularly, this invention relates to a display rack of the type having pivotable shelves.

Display racks are, of course, very well known to the prior art. A display rack is commonly used to display and, thereby, offer for sale, merchandise from the inventory of a retail store. Display racks are commonplace in retail stores such as supermarkets, department stores, grocery stores, and the like.

One common type display rack structure that has seen significant commercial use in recent years is that type which incorporates pivotable shelving in connection therewith. This type display rack structure basically includes a base with a rear wall extending upwardly from the base's rear edge. A plurality of shelves are pivotally mounted to the back wall of the display rack, the pivot axis of each of those shelves being horizontal to the rack's base. It is known to spring load these display rack shelves in a manner that permits each of the rack's shelves to move automatically from a horizontal shelf attitude into a vertical storage attitude against the rack's back wall when no article, e.g., no product package, remains on the shelf. This spring loaded shelf structure is useful in that the uppermost shelf is automatically removed from the article support attitude, i.e, the horizontal shelf position, to the storage attitude against the display rack's rear wall when no further merchandise is supported on the shelf (i.e., when the last article of merchandise on that top shelf has been removed by a prospective purchaser). This function of the spring loaded shelf permits the next lower shelf to present its merchandise for the retail consumer's view, and selection, as soon as the spring loaded shelf has been spring biased into the storage attitude.

There are a number of different display rack structures of this type known to the prior art. Typical of such spring loaded shelf display racks are those illustrated in Shiels U.S. Pat. No. 2,982,419, Pendergast et al U.S. Pat. No. 3,045,831, Pendergast U.S. Pat. No. 3,137,251 and Patterson U.S. Pat. No. 3,151,744. Display rack structures similar to those illustrated in the aforementioned patents have been used in the past to market beverages, e.g., soft drinks, in supermarkets and the like. In each of these prior art display rack structures, however, each shelf is of a one-piece shelf structure. In other words, the entire shelf and not just a section or portion thereof, moves between the horizontal support attitude and the vertical storage attitude. Thus, all merchandise must be removed from the entire shelf support area of each shelf, i.e., from the whole shelf, before the shelf can pivot from the horizontal article support attitude to the vertical storage attitude.

It has been one objective of this invention to provide a novel display rack structure in which at least one shelf plane of the display rack includes a single floor frame structure for each row of articles supportable in that shelf plane.

It has been another objective of this invention to provide a novel display rack structure in which at least one shelf plane of the display rack is comprised of a plurality of row support frames, each one of those row support frames being adapted to support an upper row of articles thereon, each one of those row frames being comprised of a right hand half section and a left hand half section with those half sections being disposed generally parallel to the vertical longitudinal plane of the row, and both of those shelf sections for each row being adapted to move in generally mirror relation between an article support attitude overlying a lower row of articles that permits the upper row's articles to be supported in that shelf plane and a storage attitude that permits the lower row of articles beneath the upper row to be removed generally vertically through the upper shelf plane.

In accord with these objectives, the display rack structure of this invention incorporates a display rack in which articles are disposed in rows parallel one to the other, each row on an upper shelf being disposed in the same vertical longitudinal plane as an underneath row on a lower shelf. In preferred form, the display rack's upper shelf is comprised of a plurality of separably operable floor frames, each floor frame being structured to serve only one row of articles. The floor frame for each of the upper shelf's rows is comprised of a right hand support section and a left hand support section, each support section being separably pivotable on a pivot axis disposed parallel to the row's vertical longitudinal plane, and the pivot axes being disposed on opposite sides of that longitudinal plane. Each row floor frame is movable between a use position in which the support sections thereof are oriented to support one or more articles in that upper row, thereby preventing the articles in the underneath row from being removed vertically out of the display rack, and a storage position in which the support sections are removed when no article is in the upper row, thereby allowing the articles in the underneath row to be lifted vertically out of the display rack. The right and left hand support sections of each row floor frame are spring loaded, the weight of at least one article on both frame sections maintaining the frame in the use attitude, and the removal of all articles from the row floor frame permitting those sections to pivot into the storage attitude.

Other objectives and advantages of this invention will be more apparent from the following detailed description taken in conjunction with the drawings in which.

Figures 1, 2, 3:
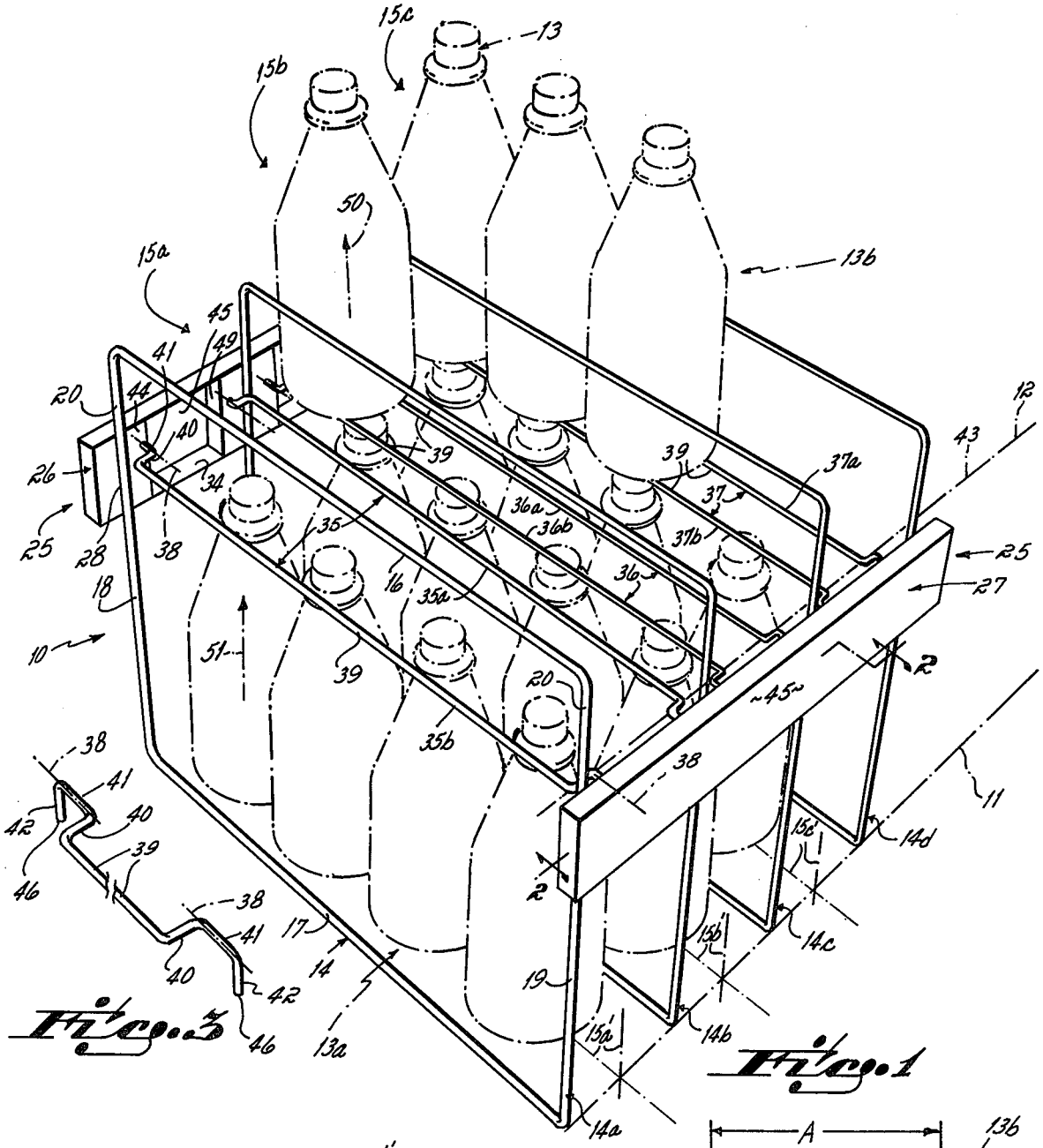
FIG. 1 is a perspective view illustrating a display rack structured in accord with the principles of this invention.
FIG. 2 is a cross-sectional view taken along line 2—2 of FIG. 1.
FIG. 3 is a partial perspective view of one of the article support wires which comprise one half sections of each row support frame.

A display rack 10 in accord with the principles of this invention is illustrated in FIG. 1. As shown in that figure, the display rack 10 is adapted to sit on ground 11, and is provided with a single upper shelf plane 12 elevated above ground 11. The ground 11, in this structural embodiment, defines a lower shelf plane, i.e., the lower shelf, for the display rack 10. The display rack 10 shown is structured to support articles in the form of bottles 13, e.g., soft drink bottles of the quart size. However, it will be apparent to a person skilled in the art that the display rack 10 also may be structured to support other articles such as other types of packages or containers, e.g., boxes.

The display rack 10 illustrated in FIG. 1 is comprised of a plurality of vertical planar row dividers 14, i.e., row defining wire frames. The planar row dividers 14 are disposed parallel one to the other, and are oriented vertically relative to the shelf planes 11, 12. Successive pairs 14a, 14b and 14b, 14c and 14c, 14d of the planar row dividers define parallel rows 15a, 15b, 15c, each row being adapted to receive a lower tier or bottles 13a supported on ground 11, and an upper tier of bottles 13b supported in shelf plane 12. Note each row of bottles 15a, 15b, 15c in the lower tier 13a is located directly underneath the respective row of bottles 15a, 15b, 15c in the upper tier 13b (bottle row 15a in tier 13b is directly over bottle row 15a in tier 13a, bottle row 15b in tier 13b is directly over bottle row 15b in tier 13a and bottle row 15c in tier 13b is directly over bottle row 15c in tier 13a as shown in FIG. 1), thereby locating each upper tier of bottles 13b and the lower tier of bottles 13a immediately underneath in the same vertical longitudinal plane 15a', 15b' or 15c' which establishes those rows.

Each of the planar row dividers 14 is comprised of a single wire element bent into a rectangular frame configuration, that row defining frame comprising top wire 16, bottom wire 17, and opposed side wires 18, 19. Note particularly that the top sections 20 of each side wire 18, 19 extend substantially above the upper shelf plane 12. This permits the dividers' top wires 16 to function as row dividers for the upper tier of bottles 13b, thereby keeping that upper tier separated into the desired rows 15a, 15b and 15c. Further, the bottom wire 17 of each row defining frame 14 cooperates with the bottles in the lower tier of bottles 13a, thereby also keeping those lower bottles separated into rows 15a, 15b, 15c.

Shelf structure 25, which structure cooperates to define the shelf plane 12 for the upper tier of bottles 13b, also functions to interconnect the planar row divider frames 14a–14d so as to maintain those frames in spaced parallel relation one with the other, see FIG. 1. The shelf structure 25, on each side of the display rack 10, is comprised of housing arms 26 and 27 fixed to each of the row dividers 14a, 14b, 14c and 14d. A typical fixed joint for each frame 14 to arms 26, 27 is shown at 28 where side wire 18 of frame 14a is tack welded or the like to arm 26. Since the housing arms 26, 27 are fixedly connected to the row divider frames 14 on each side of the display rack, e.g., by welding those frames 14 are maintained in the space parallelism alignment desired, and as illustrated in FIG. 1.

The shelf structure 25 for the upper tier of bottles 13b is of the pivotable shelf type as will appear below. The shelf structure 25 is comprised of multiple row floor frames 35–37, one row floor frame being provided for each of the upper rows 15a–15c of tier 13b. In other words, a separate floor frame 35–37 is provided for each of the upper tier rows 15a–15c, all of those floor frames being positionable in the article support attitude in the same shelf plane 12. More specifically, and as is illustrated in all of the figures, each row floor frame 35–37 is comprised of a right hand half section 35a, 36a, 37a and a left hand half section 35b, 36b, 37b when that frame is viewed in a line of sight which lies in the longitudinal plane 15a'–15c' of the row. Each of the floor frames' half sections 35a–37a and 35b–37b is pivotable on a pivot axis 38 parallel to the longitudinal plane 15a'–15c' of the row it serves, the pivot axes being spaced equidistant from that longitudinal center plane on opposite sides thereof.

Each of the floor frames' half sections 35a–37a, 35b–37b is comprised of a floor wire 39, i.e., an article support wire, that extends from adjacent one support arm 26 to adjacent the other support arm 27 on opposite sides of the display rack, those wires 39 being oriented parallel one to the other and parallel to the longitudinal planes 15a'–15c'. Each end of an article support wire 39 is connected by dog leg 40 to bearing rod 41, the bearing rods on opposite ends of the floor wire 39 defining the pivot axis 38 of that floor wire. That end of each bearing rod 41 not connected to the floor wire 39 is provided with an operator arm 42 perpendicular thereto, the operator arm also being perpendicular to the frame plane 43 which is the shelf plane 12 defined by the support wire, dog leg, and bearing rod, see FIG. 2 particularly. The bearing rod 41 at each end of each floor wire 39 is received in bearing plate 44, that bearing plate being fixed to the appropriate one of channel-like housing arms 26, 27 as by welding or the like. The operator arms 42, being at opposite outer ends of each floor wire 39, are thereby enclosed between the respective bearing plates 44 and each housing arms' wall 45, see FIG. 1.

The extremity 46 of each operator arm 42 is connected by tension spring 47 to the bottom web 34 of the respective housing arm 26, 27 as at 48. Each spring 47 is in tension at all times, thereby continuously spring biasing the floor wire 39 of floor frame 35–37 toward the storage attitude illustrated in the row 15a in FIGS. 1, 2 and 3.

The support attitude of each floor frame 35–37 is illustrated in rows 15b and 15c of FIGS. 1 and 2. As shown for row 15b, the support wires 39 of floor frame half sections 36a, 36b are pivoted on pivot axes 38 to a location closely adjacent the longitudinal center plane 15b', of that row against the bias of springs 47, thereby defining a support floor, i.e., a floor frame support, for row 15b of bottles 13 in tier 13b. In this article support attitude of each row floor frame 35–37, the operator arms 42 abut against stops in the form of inner ribs 49 to locate the floor wires 39, and to restrain the floor wires 39, in the shelf support plane 12.

In the floor frame 35–37 storage attitude, each operator arm 42 abuts inner rib 49 fixed to the respective housing arm 26, 27, as biased thereto by spring 47, thereby locating each respective floor wire 39 of frame half section 35a, 35b, 36a, 36b, 37a, 37b in the storage attitude within the shelf plane 12 when no article is supported thereon as shown in the row 15a in FIG. 2. In other words, each operator arm 42 and, hence, each floor wire 39 cooperates with a stop in the form of inner rib 49 to locate each floor frame half section 35a, 35b, 36a, 36b, 37a and 37b of a row floor frame 35–37 in the shelf plane 12 in the storage attitude.

In use, each of the row floor frames 35–37 within the top shelf plane 12 is movable or swingable independent one of the other between a storage attitude (frame 35) and an article support attitude (frames 36 and 37). In other words, the row floor frame 37 of a rear row 15c may be in the support attitude (as illustrated in FIG. 1) while simultaneously the row floor frame 35 of the front row 15a may be in the storage attitude (also as illustrated in FIG. 1). In loading the rack with bottles prior to any being removed therefrom, the lower tier of bottles 13a are first aligned in rows on the lower shelf plane, i.e., ground 11, four bottles in each row as shown in FIG. 1. Thereafter, the support wires 39 of a row floor frame 35 or 36 or 37 are pivoted against the tension of springs 47 into the article support attitude in the shelf plane 12, the support wires being located in that support attitude by operator arms 42 abutting against stops defined by inner ribs 49, see rows 15b and 15c in FIGS. 1 and 2. With the support wires 39 of a row 15b or 15c so oriented, an upper tier of bottles 13b may be placed thereon. A single bottle 13, i.e. a single article, located on the support wires 39 of one row floor frame 35 or 36 or 37 in this article support attitude is sufficient to overcome the spring force of the tension springs 47 attached to the operator arms 42, thereby maintaining the support wires in that floor support attitude. Note in this article support attitude of each floor frame 35–37 that the linear support wires 39 are spaced one from another a width W substantially less than the width A of the article 13 to be supported thereon, see particularly FIG. 2. In other words, the width W between the linear support wires 39, which support wires are parallel to the longitudinal plane 15*b'* of the row, is significantly less than the diameter of the bottles 13 supported thereon. This spatial relation of the linear support wires 39 to the width A of the article to be supported, of course, supports and displays the article to be supported in the upper shelf plane 12. Of course, each of the upper tier rows 15*a*, 15*b*, 15*c* is filled with bottles 13 in a like manner so as to completely fill the display rack 10 with merchandise, thereby presenting the upper tier of bottles 13*b*, at least in front row 15*a*, as the first bottles for removal by prospective purchasers.

As the bottles of upper tier 13*b* are removed by retail customers one, or two, or more, at a time, that removal occurs by drawing the bottle upward in a generally vertical direction as indicated by phantom arrow 50. As the last bottle in, for example, row 15*a* is withdrawn, the support wires 39 of that row automatically flip or spring away 180° into the storage attitude illustrated in row 15*a* of FIG. 2. The support wires 39 of row 15*a* are located in the shelf plane 12 when in the storage attitude as well because operator arms 42 again cooperate with the inner ribs 49 to locate those support wires in that storage attitude in response to tension springs 47. With the linear and parallel support wires 39 located in the storage attitude, note that the width W' between those wires is substantially greater than the width A of the articles of lower tier 13*a* in row 15*a* immediately underneath in lower shelf plane 11, i.e., the width W' between the support wires 39 is significantly greater than the diameter of the bottles 13. This spatial relation of the linear support wires 39 for an upper shelf plane 12 when in the storage attitude, vis-a-vis the diameter of the bottles 13, permits those bottles 13 in the front row 15*a* in the lower shelf plane 11, i.e., in the lower tier 13*a*, to be drawn upwardly generally in a vertical direction so as to withdraw those bottles up out of the rack 10 between the pair of wires 39, as illustrated by phantom arrow 51. This structure, of course, permits the retail customer to choose from the bottles in the lower tier 13*a* in the front row 15*a* of the display rack 10, or from the bottles in the top tier 13*b* in the middle 15*b* or back 15*c* rows of the display rack, when the rack is filled with bottles 13 to the extent shwon in FIG. 1.

Having described in detail the preferred embodiment of my invention, what I desire to claim and protect by Letters Patent is:

1. In a display rack in which articles may be disposed in rows parallel due to the other, each row of an upper shelf being disposed in the same vertical longitudinal plane as an underneath row of a lower shelf, the improvement in upper shelf structure for said display rack comprising:

a plurality of separably operable floor frames that cooperate to define the shelf plane of said upper shelf, each of said floor frames being structured to serve only one row on said upper shelf, each of said floor frames including a right hand support section and a left hand support section, each support section being movable between an article support position in which said floor frame is oriented in the shelf plane of that upper shelf row for supporting articles thereon, and a storage position in which said support sections are removed from said article support position when no article is in the upper row for allowing the articles that may be in the underneath row to be lifted vertically out of said display rack.

2. An improved upper shelf structure as set forth in claim 1 in which each support section is separably pivotable on a pivot axis disposed parallel to the vertical longitudinal plane of its row, the pivot axes of said support sections being disposed on oppposite sides of that longitudinal plane.

3. An improved upper shelf structure as set forth in claim 1 including:

spring means connected with said right and left hand support sections, the weight of at least one article on both frame sections of a floor frame maintaining that frame in the article support position, the removal of all articles from both sections of that floor frame permitting both said sections to pivot into the storage position.

4. An improved upper shelf structure as set forth in claim 1 in which the shelf plane of said upper shelf is fixed relative to the shelf plane of said lower shelf.

5. An improved upper shelf structure as set forth in claim 2 in which each support section is comprised of a generally linear support wire, said support wire extending from adjacent one end of a row to adjacent the other end of said row.

6. An improved upper shelf structure as set forth in claim 5, said support wires being disposed in the shelf plane of said upper shelf in both the article support position as well as in the storage position.

7. An improved upper shelf structure as set forth in claim 3, each of said right and left hand support sections including:

an operator arm connected to each support section, said operator arm being oriented generally perpendicular to the plane of that support section to which it is connected, and said spring being connected to the free end of said operator arm.

8. An improved upper shelf structure as set forth in claim 1 including:

a plurality of row dividers connected with said upper shelf structure, said row dividers being oriented generally perpendicular to the shelf plane of said upper shelf, and said dividers being sized to extend above as well as below the shelf plane of said upper shelf.

9. An improved upper shelf structure as set forth in claim 8 including:

a housing arm on each side of said display rack, said housing arm being directly connected with said row dividers for maintaining said dividers in spaced parallel relation one with the other, and said plurality of floor frames being mounted between said housing arms.

10. An improved upper shelf structure as set forth in claim 9, each of said right and left hand support sections being comprised of:

a support wire pivotable on a pivot axis disposed parallel to the vertical longitudinal plane of its row, the pivot axes of the two support wires that define said right hand and left hand support sections being disposed on opposite sides of that longitudinal plane;

a bearing rod connected with said support wire at each end thereof, said bearing rods being received in said housing arms to establish said pivot axes;

an operator arm connected to at least one of said bearing rods on each support wire, said operator arm being disposed generally perpendicular to the plane defined by said support wire, and;

a spring connected between said operator arm and said housing arm, the weight of at least one article on both support wires on a floor frame maintaining that frame in article support position, and the removal of all articles from both sections of that floor frame permitting both said sections to pivot into the storage position.

11. A floor frame for an upper shelf of a display rack having upper and lower shelves said display rack's upper and lower shelves each defining one row, said upper shelf row being disposed in the same vertical longitudinal plane as said lower shelf row, said floor frame comprising:

a right hand support section and a left hand support section, each support section being separably pivotable on a pivot axis disposed parallel to said row's vertical longitudinal plane, said pivot axes being disposed on opposite sides of that longitudinal plane, and said right hand and left hand support sections being movable between an article support position in which said sections are oriented in the shelf plane of said upper shelf row for supporting articles in that upper shelf row, and a storage position in which said support sections are removed from said article support position when no article is in said upper shelf row for allowing articles that may be in said lower shelf row to be lifted vertically out of said display rack, and:

a spring connected with each of said right and left hand sections, said spring permitting the weight of at least one article on both frame sections to maintain said floor frame in the article support position, and the removal of all articles from said floor frame permitting said spring to swing said right and left hand sections into the storage position.

12. An improved upper shelf structure as set forth in claim 11 in which the shelf plane of said upper shelf is fixed relative to the shelf plane of said lower shelf.

13. An improved upper shelf structure as set forth in claim 11 in which each support section is comprised of a generally linear support wire, said support wire extending from adjacent one end of a row to adjacent the other end of said row.

14. An improved upper shelf structure as set forth in claim 13, said support wires being disposed in the shelf plane of said upper shelf in both the article support position as well as in the storage position.

15. An improved upper shelf structure as set forth in claim 11, each of said right and left hand support sections including:

an operator arm connected to each support section, said operator arm being oriented generally perpendicular to the plane of that support section to which it is connected, and said spring being connected to the free end of said operator arm.

16. An improved upper shelf structure as set forth in claim 11 including:

a plurality of row dividers connected with said upper shelf structure, said row dividers being oriented generally perpendicular to the shelf plane of said upper shelf, and said dividers being sized to extend above as well as below the shelf plane of said upper shelf.

17. An improved upper shelf structure as set forth in claim 16 including:

a housing arm on each side of said display rack, said housing arm being directly connected with said row dividers for maintaining said dividers in spaced parallel relation one with the other, and said plurality of floor frames being mounted between said housing arms.

18. An improved upper shelf structure as set forth in claim 17, each of said right and left hand support sections being comprised of:

a support wire pivotable on a pivot axis disposed parallel to the vertical longitudinal plane of its row, the pivot axes of the two support wires that define said right hand and left hand support sections being disposed on opposite sides of that longitudinal plane;

a bearing rod connected with said support wire at each end thereof, said bearing rods being received in said housing arms to establish said pivot axes;

an operator arm connected to at least one of said bearing rods on each support wire, said operator arm being disposed generally perpendicular to the plane defined by said support wire, and;

a spring connected between said operator arm and said housing arm, the weight of at least one article on both support wires of a floor frame maintaining that frame in article support position, and the removal of all articles from both sections of that floor frame permitting both said sections to pivot into the storage position.

* * * * *

UNITED STATES PATENT AND TRADEMARK OFFICE

CERTIFICATE OF CORRECTION

PATENT NO. : 4,099,625
DATED : July 11, 1978
INVENTOR(S) : Rafael T. Bustos

It is certified that error appears in the above-identified patent and that said Letters Patent are hereby corrected as shown below:

Column 5, line 60, Claim 1, "due" should be -- one --

Column 7, line 14, Claim 10, "on" should be -- of --

Signed and Sealed this

Ninth Day of January 1979

[SEAL]

Attest:

RUTH C. MASON
Attesting Officer

DONALD W. BANNER
Commissioner of Patents and Trademarks